US005685380A

United States Patent [19]

Purcell et al.

[11] Patent Number: 5,685,380

[45] Date of Patent: Nov. 11, 1997

[54] REVERSE CIRCULATION DOWN-THE-HOLE DRILL

[75] Inventors: Joseph Purcell; Patrick Purcell, both of Kewdale, Australia

[73] Assignee: Minroc Technical Promotions Limited, Ireland

[21] Appl. No.: 580,616

[22] Filed: Dec. 29, 1995

[30] Foreign Application Priority Data

Jan. 6, 1995 [IL] Israel ..... 950010

[51] Int. Cl.[6] ..... E21B 21/12; E21B 4/14

[52] U.S. Cl. ..... 175/215; 173/136; 175/296

[58] Field of Search ..... 175/215, 296, 175/297; 173/136

[56] References Cited

U.S. PATENT DOCUMENTS

| | | | |
|---|---|---|---|
| 4,084,646 | 4/1978 | Kurt | 173/17 |
| 4,790,390 | 12/1988 | Sweeny | 173/17 |
| 4,819,746 | 4/1989 | Brown et al. | 175/296 |
| 4,917,194 | 4/1990 | Eaton | 175/215 X |
| 4,921,052 | 5/1990 | Rear | 173/78 |

FOREIGN PATENT DOCUMENTS

| | | | |
|---|---|---|---|
| 40654/85 | 11/1985 | Australia . | |
| 52436/86 | 7/1987 | Australia . | |
| 72222/87 | 12/1987 | Australia . | |
| 80143 | 4/1988 | Australia | 175/296 |
| 120493 | 5/1990 | Japan | 175/296 |
| 2175941 | 12/1986 | United Kingdom . | |

*Primary Examiner*—David J. Bagnell

*Attorney, Agent, or Firm*—Burns, Doane, Swecker & Mathis, LLP

[57] ABSTRACT

A reverse circulation down-the-hole drill includes an outer wear sleeve (1) and a backhead (2) assembly located at one end of the outer wear sleeve (1) for connecting the drill to a double-walled drill string and to a source of pressure fluid to actuate the drill. A fluid diverter (5) is mounted inside the outer wear sleeve (1) adjacent to the backhead (2). An inner tube (9), concentric with the outer wear sleeve (1) and extending into the fluid diverter (5), defines at least part of a central return passageway in the drill. A bit (10), located by a chuck (3) at the other end of the outer wear sleeve (1), is slidably mounted on the inner tube (9) in an annular chamber (28, 30) defined by the outer wear sleeve, by the inner tube, by the diverter at one end (28), and by the bit at the other end (30). An inner cylinder (6) mounted inside the outer wear sleeve (1) towards said one end (28) of the chamber adjacent to the diverter defines a fluid communication passage (8) between the diverter and the chamber via porting elements (26, 27). A piston (14) is slidably disposed in the annular chamber (28, 30) with respect to the inner cylinder (6) so as to co-operate with the porting elements (26, 27). The piston is mounted over the inner tube (9) to reciprocate within the annular chamber and repeatedly strike the bit (10). Improved performance is provided, wherein the face (18) of the piston (14) adapted to strike the bit (10) is defined by a reduced diameter front end portion of the piston. The piston (14) defines a shoulder (29) facing said one end (28) of the chamber opposite the strike face of the piston to which a substantially continuous supply of pressure fluid is applied via the porting elements (26, 27). The inner cylinder (6) extends only part-way into the annular chamber. The porting elements (26, 27) are adapted to apply pressure fluid to the piston so as to maintain a force on the shoulder (29) in the direction of the bit (10) of approximately 30 to 45% of the lift force on the lift face 32 during the lift stroke.

5 Claims, 2 Drawing Sheets

REVERSE CIRCULATION DOWN-THE-HOLE DRILL

The present invention relates to an improved rock drill, in particular to an improved reverse circulation down-the-hole (DTH) hammer drill actuated by a fluid such as compressed air.

DESCRIPTION OF THE PRIOR ART

In the DTH drill art, there are two types of operating cycle referred to as "normal" circulation, and "reverse" circulation. In both cases, compressed air is supplied alternatively via porting arrangements in the drill to a piston within a chamber so as to drive the piston forwardly towards a bit mounted for sliding movement in a chuck at the forward end of the drill, to strike the bit at the end of its downward stroke, and then to lift the piston in the opposite direction within the chamber, whereupon the cycle is repeated. In the normal circulation system, air is exhausted to the front and sides of the bit, to return to the surface carrying cuttings and debris in the annular space between the borehole wall and the drill string. In the reverse circulation system, a central bore or passageway is defined through the drill string, the drill piston and bit, wherein exhaust air including cuttings and debris is directed through the central passageway within the drill itself. The principal advantage of the normal circulation system is that a piston can be designed with a greater surface area available for application of driving and lift forces, but suffers from the drawback that rock sample which is returned to the surface may be contaminated during its travel up the borehole, so that accurate sampling when drilling is not possible. The principal advantage of the reverse circulation system is that it allows accurate sampling when drilling because cuttings which are returned to the surface through the central passageway are isolated from the borehole. However, the drawback is that the provision of the central passageway provided by an inner tube passing through the main chamber housing the piston effectively reduces the available surface area for application of driving and lift forces when designing the piston.

Normal Circulation DTH Drill cycles

Cycle 1 [e.g. as described in U.S. Pat. No. 4,084,646 (Ingersoll-Rand Company)]

Lift Stroke

When the piston has struck the face of the bit, air is transferred to the strike face of the piston via a porting arrangement which causes the piston to lift off the face of the bit. The value of the lifting force depends upon the strike face area multiplied by the air pressure exerted on the strike face, minus the force exerted by the weight of the piston and air pressure continually exerted on an intermediate shoulder on the piston opposite the strike face. The value of the force exerted on the shoulder of the piston opposite the strike face is typically 30–45% of the force exerted on the lower lift face area at the strike face end of the piston. The effective strike face surface area is reduced somewhat on account of a foot valve extending from the center of the strike face of the bit which cooperates with a central bore defining an exhaust passageway in the bit. The piston continues to lift until the end of the foot valve is exposed, whereupon air in the lift chamber starts to exhaust through the exhaust passageway in the bit. Due to its momentum, the piston continues to lift until air is transferred into a chamber created at the rear of the piston between an inner cylinder and a sealing probe.

Driving Stroke

As the air in the rear chamber is compressed, a cushioning or downward force begins to be exerted upon the rear face of the piston, which combines with the force on the intermediate shoulder referred to above so as to stop the upward momentum and reverse the direction of the piston towards the bit. During its travel towards the bit, the rear chamber exhausts once the sealing probe is uncovered. The piston then strikes the bit and the cycle repeats itself.

As already mentioned above, the value of the downward force on the piston shoulder opposite the strike face is typically 30–45% of the force exerted on the lower lift face (discounting the piston weight), during the lift stroke. This has been found to provide the correct balance between an inner cylinder of adequate cross-section, so that porting grooves can be machined therein, while still maintaining strength and allowing for a piston of sufficient cross-sectional area at its strike face to lift during the commencement of the lifting stroke.

Cycle 2 (e.g. as described in our U.S. Pat. No. 4,790,390)

This is similar to Cycle 1 described above, except for the addition of a compression force on an intermediate shoulder of the piston which provides an additional impetus to the piston on its drive stroke without continuously supplying live compressed air to the piston which increases the driving force and thus the strike energy. Loss of working pressure by leakage through clearance gaps is also kept to a minimum.

Both of the DTH drill Cycles 1 and 2 described above rely on a type of piston which has a foot valve governing the length of time that the lift force is applied to the strike face of the piston.

Cycle 3

Another type of DTH drill cycle relies instead on a piston having a reduced diameter at the strike face, which co-operates with a cylindrical bush when in the strike position. This cylindrical bush is used instead of a foot valve to govern the length of time that the lift force is applied to the lift face of the piston.

Lift Stroke

To lift the piston, air is transferred to a chamber formed between the main diameter of the piston and the reduced diameter, such that the lifting force is given by the area of the main diameter minus the area of the reduced diameter multiplied by the air pressure. Unlike Cycles 1 and 2 referred to above, the only force working against the travel of the piston away from the bit is determined by the weight of the piston itself. This is also due to the fact that there is no force operating on a shoulder opposite the lift face as in Cycles 1 and 2 as the largest diameter is unchanged between the lift face and the driving face. The piston continues to travel away from the bit until the reduced diameter portion clears the cylindrical bush causing the lifting chamber to exhaust.

Driving Stroke

Momentum causes the piston to continue its travel until the direction is reversed by a force acting on the rear face of the piston, created by pressurised air in a chamber formed between the main diameter of the rear face of the piston, the inner cylinder and a sealing probe. The piston then continues its travel until it strikes the bit.

The disadvantage of this type of DTH drill cycle is that air must be supplied through porting along the sides of the piston which effectively reduces the diameter of the piston. It will be appreciated that the overall energy output is heavily dependent upon the largest diameter of the piston. Another disadvantage is the fact that the cross-sectional area of the lift face of the piston is significantly less than systems which utilise a foot valve, and is constrained by the necessity to provide a reduced diameter portion of the strike face of the piston of sufficient size and cross-section for strength.

Reverse Circulation DTH Drill Cycles

Cycle 4 (e.g. as described in our U.S. Pat. No. 4,819,746)

Lift Stroke

From the striking position, the piston is lifted from the bit by the application of pressure air to a shoulder at the front of the bit and/or defined in an intermediate groove on the piston. Once the piston clears or rebounds from the striking face of the bit, pressurised air is applied directly to the striking surface of the piston. In a foot valve arrangement, air is exhausted from the forward chamber once the piston clears the foot valve, air passing through an annular space defined between the foot valve and an inner tube disposed in respective central bores in the piston and bit, such that exhaust air emerges through openings at the cutting face of the bit. Air may be trapped inside grooves in the piston and caused to expand so as to exert a continuing rearward force on the piston. As a sealing probe or backhead air diverter stem enters the rear face of the piston, a rear chamber is formed in which air is compressed to cushion the piston and reverse its direction.

Driving Stroke

Air is transferred from the intermediate groove or chamber to the rear chamber to provide additional forward impetus to the piston which then strikes the bit and the cycle repeats itself. All air is exhausted to the front face of the bit to return through a central exhaust passageway defined in the bit and by the inner tube.

The diameter of the piston is maximised thus giving an optimum output energy performance, and it is relatively simple to achieve a downward force on the piston shoulder opposite the strike face which is 30–45% of the force on the lower lift face during the lift stroke. However there is the disadvantage of blockages which may occur in the flushing exhaust air supply apertures at the cutting face of the bit, not to mention the problem of fall back of debris suspended in the return passage if there is a temporary loss of exhaust air pressure.

Cycle 5 [e.g. BULROC (Trade Mark) system]

This utilises essentially the same stroke cycle as described above with reference to Cycle 3, in that the exhaust air to flush and clear cuttings from the cutting face of the bit is supplied via gaps between the splines of the bit and the drive sub. After exiting the drive sub, the exhaust air is supplied to the cutting face via longitudinal grooves in the circumference of the bit around the cutting face. This system very rarely suffers from blockages in the flush air supply. There is however a severe disadvantage with the stroke as described above with reference to Cycle 3 in that the amount of energy available is reduced due to the reduced diameter of the piston (as it is necessary to have an inner cylinder extending the length of the piston chamber as well as the outer wear sleeve).

BACKGROUND TO THE INVENTION

It is an object of the present invention to combine the best characteristics of the normal circulation DTH drill cycles found in the prior art in an improved reverse circulation DTH drill. It would be desirable to have a piston with a reduced diameter portion at the strike face which co-operates with a bush structure instead of a foot valve (e.g. Cycles 3 and 5), but at the same time to maximise the main piston diameter with a DTH cycle operating generally in the same manner as in Cycle 1 [e.g. U.S. Pat. No. 4,084,646 (Ingersoll-Rand)] and in Cycle 2 [e.g. U.S. Pat. No. 4,790,390(Minroc)]. However, it is extremely difficult to do this in a manner which combines the optimal features of both systems. The difficulties may be summarised as follows:

(a) The cross-section of the striking surface area of the reduced diameter portion of the face of the piston must be sufficiently large to provide for adequate strength, but not so large as to effectively reduce the remaining available surface area comprising the lift face of the piston thereby compromising the lift force which can be applied.

(b) The inner cylinder must be of sufficient cross-section to have grooves machined therein while still maintaining adequate strength. However, a reduction in the cross-section of the inner cylinder allows for a reduced cross-sectional area on the piston shoulder opposite the strike face but it is difficult to reduce the cross-section of the inner cylinder much more than in the case of the prior art "normal circulation DTH drills" described above, so as to produce any significant change in the force to be opposed during the lift stroke on the shoulder of the piston opposite the strike face.

(c) The downward force on the piston shoulder opposite the strike face must be 30–45% of the force on the lift face during the lift stroke. Because of the effective reduction in the lift force by virtue of a reduced lift face surface area, and the lack of a significant change in the opposing force applied during the lift strike, this is almost impossible to achieve.

The present invention seeks to overcome these difficulties by providing a reverse circulation DTH drill which combines features from the normal circulation drill cycles described above with reference to Cycle 1 [e.g. U.S. Pat. No. 4,084,646(Ingersoll-Rand)] or Cycle 2 [e.g. U.S. Pat. No. 4,790,390(Minroc)] together with the reduced diameter piston strike face as exemplified in Cycles 3 and 5, while still maintaining a force on a piston shoulder of about 30–45% of the force on the lift face during the lift stroke. This is mainly achieved by a modified porting arrangement between the piston and the inner cylinder, and between the piston and the inner tube.

SUMMARY OF THE INVENTION

According to the present invention, there is provided a reverse circulation down-the-hole comprising:

an outer wear sleeve;

a backhead assembly located at one end of the outer wear sleeve for connecting the drill to a double-walled drill string and to a source of pressure fluid to actuate the drill;

a fluid diverter mounted inside the outer wear sleeve adjacent to the backhead;

an inner tube concentric with the outer wear sleeve and extending into the fluid diverter and defining at least part of a central return passageway in the drill;

a bit located by a chuck at the other end of the outer wear sleeve, slidably mounted on the said inner tube in an annular chamber defined by the outer wear sleeve, by the inner tube, the diverter at one end, and by the bit at the other end;

an inner cylinder mounted inside the outer wear sleeve towards said one end of the chamber adjacent to the diverter defining a fluid communication passage between the diverter and the chamber via porting means;

a piston slidably disposed in the said annular chamber with respect to the inner cylinder so as to co-operate with the porting means and mounted over the inner tube to reciprocate within the annular chamber and repeatedly strike the bit, defining a shoulder intermediate its end, one of which defines a lift face, wherein the face of the piston adapted to strike the bit is defined by a reduced diameter front end portion of the piston, the piston defines a shoulder facing said one end of the chamber opposite the strike face of the piston to which a substantially continuous supply of pressure fluid is applied via the porting means, the inner cylinder extends only part-way into the said annular chamber, and the porting means is adapted to apply pressure fluid to the piston so as to maintain a force on the shoulder in the direction of the bit of approximately 30 to 45% of the lift force on the lift face during the lift stroke.

Preferably, sliding contact between the piston and the inner tube disposed within the annular chamber is restricted to a portion of the length of the inner tube of larger external diameter as compared to the remainder of the inner tube being spaced from the diverter, over which enlarged portion the piston moves so as to provide for a clearance gap between the said remainder of the inner tube and the piston, and so define a passage for exhausting pressure fluid from the said one end of the chamber to the other end, past the piston, during the end of the driving stroke and at the commencement of the lift stroke.

Preferably, the reduced diameter front end portion of the piston is adapted to co-operate with a bush mounted fixedly within the outer wear sleeve, wherein the bush defines a chamber to supply pressure fluid to the lift face of the piston at the commencement of the lift stroke.

The porting means preferably comprises a plurality of first ports defined in the inner cylinder adapted to communicate with ducts defined in the piston so as to communicate pressure fluid to the said one end of the chamber adjacent to the diverter to arrest the movement of the piston towards the end of the lift stroke, a plurality of second ports defined in the inner cylinder, spaced from the first ports, to communicate a continual supply of pressure fluid to said shoulder on the piston.

Preferred embodiments of a reverse circulation DTH drill in accordance with the invention will now be described with reference to the accompanying drawings, in which:

FIG. 1 is a sectional side elevation of a drill according to a first embodiment of the invention, showing the piston at the commencement of the driving stroke, FIG. 2 is a sectional side elevation, as in FIG. 1, but showing the piston at the commencement of the lift stroke, having struck the bit, FIG. 3 is a sectional side elevation of a drill according to a second embodiment of the invention, showing the piston at the commencement of the drive stroke, and FIG. 4 is a sectional side elevation of drill as in FIG. 3, but showing the piston at the commencement of the lift stroke.

DETAILED DESCRIPTION OF THE INVENTION

Figure 1:
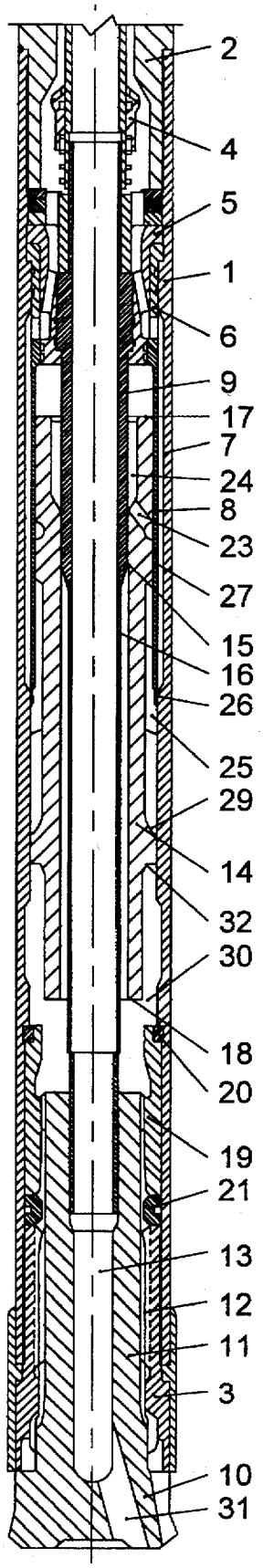
Figure 2:
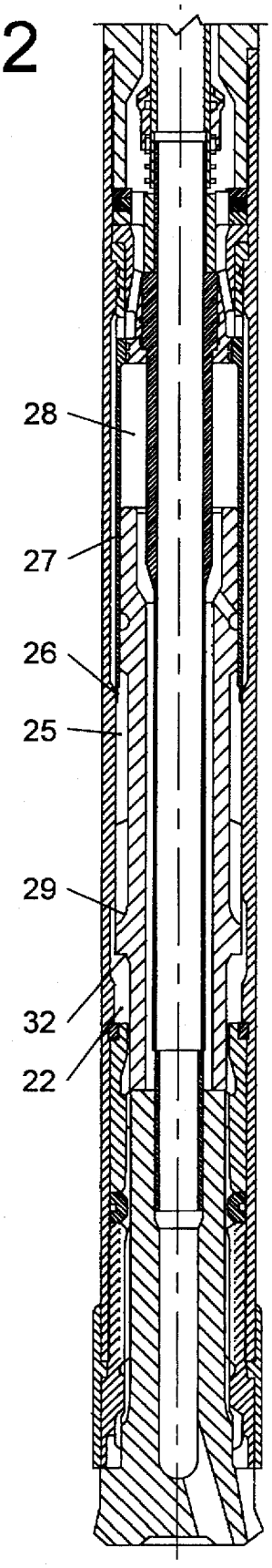

Referring to FIGS. 1 and 2 of the drawings, a reverse circulation DTH drill driven by a supply of compressed fluid such as a gas, typically air, has an outer wear sleeve 1, secured at its rear end to a backhead 2 and at the forward end to a chuck 3. A check valve 4 is in sealing engagement with the backhead 2. An inner cylinder 6 is mounted on an air diverter 5 and a groove 7 is formed in the outer wear sleeve 1 adjacent to the inner cylinder 6 so as to form an annular gap 8 between the outer wear sleeve 1 and the inner cylinder 6.

An inner tube 9 is machined so as to fit within a central bore in the air diverter 5 at one end, and extends concentrically through the outer wear sleeve 1 and into a central bore 13 in a rearwardly extending stem 11 of a drill bit 10. The stem 11 of the drill bit 10 is held within a chuck 3 by means of splines 12 between the chuck and the bit, such that the bit is suspendibly mounted over the inner tube 9. An annular chamber is therefore formed between the air diverter 5 and the bit 10 around the inner tube 9, over which a piston 14 is adapted to slide within the chamber. It should be noted that an enlarged diameter portion 15 of the inner tube 9 is the only part of the inner tube 9 on which sliding contact is made by the piston 14. This leaves an annular gap 16 between the piston and the inner tube 9. The piston 14 defines a rear face 17 and a front end portion of reduced diameter which defines a lift face 32 at its opposite end. The reduced diameter portion of the piston co-operates and fits within a bush 19 held between fixed ring bearings 20, 21 so as to fixedly secure the bush 19 to the outer wear sleeve 1. A chamber 22 is defined between the piston 14 and the bush 19 (see FIG. 2).

The piston 14 also includes rearwardly-directed ducts 23 towards the rear face 17 and communicating therewith via a bore 24 to the annular chamber. The intermediate section of the piston 14 is machined to form a passage 25 which communicates with the annular gap 8 via a series of ports 26 at the front end of the inner cylinder 6. Ports 27 spaced therefrom provide communication between the annular gap 8 and the ducts 23 when the piston reaches the position shown in FIG. 1.

At the commencement of the drill cycle with the piston 14 in the position shown in FIG. 2, compressed air is supplied via the air diverter 5, the annular gap 8, through ports 26, passage 25 around the sides of the piston to chamber 22 so as to be applied to the strike face 18 of the piston, thereby lifting the piston away from the bit.

The piston 14 continues to lift until the end of the piston exits the bush 19 to a position as shown in FIG. 1. Compressed air in the lift chamber 22 is then exhausted via passageways defined between the splines 23 of the bit to the bottom of the hole and the cutting face of the bit 10, so as to pass through a return passage 31 into the central return passageway defined by the inner tube 9, carrying with it debris and rock cuttings. The piston 14 continues to travel rearwardly under its own momentum. At the precise position shown in FIG. 1, air is transferred via ports 27, duct 23 and bore 24 to the rear chamber 28 to cushion the rearward movement of the piston and reverse its direction. Air in the chamber 28 is compressed once the chamber is sealed when the bore 24 clears the enlarged diameter portion 15 of the inner tube 9, which acts as a sealing probe.

During the drive stroke, and also during the lift stroke, compressed air is supplied continually through ports 26 to a shoulder 29 on the piston.

When the piston 14 strikes the bit, i.e. as shown in FIG. 2, the chamber 28 may be exhausted via passageways defined between the splines 12 to the bottom of the hole and the cutting face of the bit 10, so as to pass through a return passage 31 into the central return passageway defined by the inner tube 9, carrying with it debris and rock cuttings.

Figure 3:
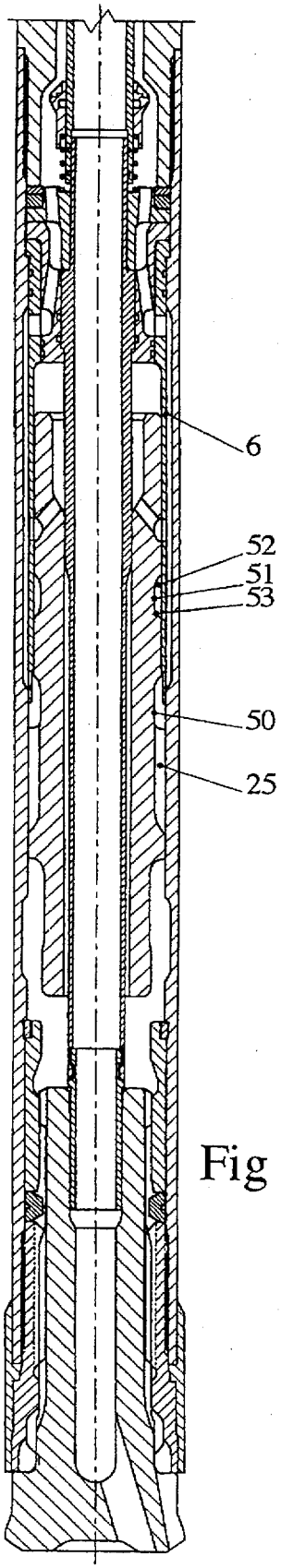
Figure 4:
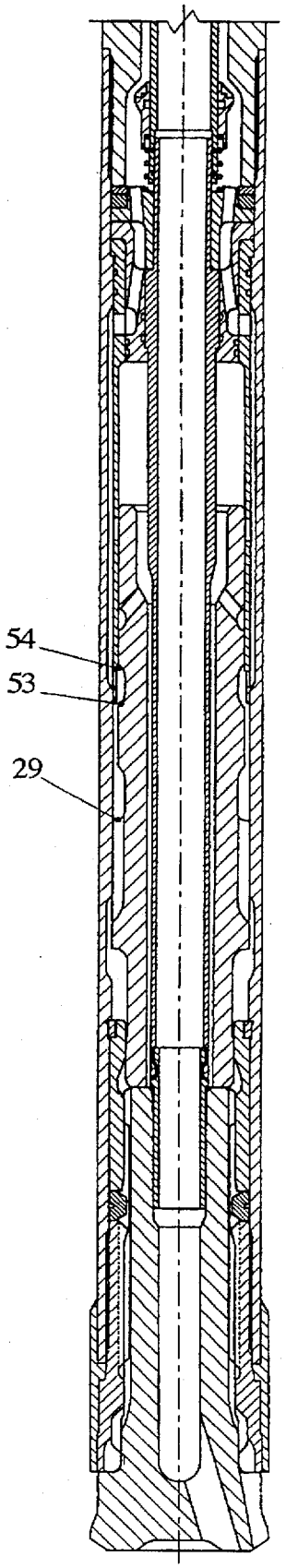

An alternative embodiment will now be described with reference to FIGS. 3 and 4. The only difference between the embodiment and that described above with reference to FIGS. 1 and 2 is in the provision of two separate grooves 50, 51 on the side of the piston 14, forming an additional chamber 52 (see FIG. 3) and an additional shoulder 53. Pressure air is supplied to the shoulder 53 towards the end of the drive stroke and at the commencement of the lift stroke (see FIG. 4). During the lift stroke shoulder 53 cuts off the supply of pressurised air to chamber 25 when it passes over edge 54 of the inner cylinder. Thus the supply of pressure air to shoulder 29 is not continuous in this case. However, pressurised air in chamber 25 is further compressed thus acting as an additional braking force to arrest the rearward motion of the piston 14 and give additional impetus to the driving stroke.

In another aspect, the invention provides an improved by-pass means for diverting exhaust air flow directly to the inner tube 9 via venturi orifices in the inner tube. Such a system is described in our U.S. Pat. No. 4,819,746 comprising simple apertures towards the front end of the inner tube. Alternative by-pass and flushing systems to cause additional lift in the inner tube are described in AU-B40654/85 and AU-B72222/87 (Ennis), but a problem with these prior art by-pass systems which produce a venturi or suction effect is that air is continually diverted to the inner tube and cannot be closed off when the drill is lifted from the bottom of the hole and the air supply is reversed back down through the central passageway to remove any blockages. The result is that debris can pass back into the drill chambers which is to be avoided.

We claim:

1. A reverse circulation down-the-hole drill comprising:

an outer wear sleeve;

a backhead assembly located at one end of the outer wear sleeve for connecting the drill to a double-walled drill string and to a source of pressure fluid to actuate the drill;

a fluid diverter mounted inside the outer wear sleeve adjacent to the backhead;

an inner tube concentric with the outer wear sleeve and extending into the fluid diverter and defining at least part of a central return passageway in the drill;

a bit located by a chuck at the other end of the outer wear sleeve, slidably mounted on said inner tube in an annular chamber defined by the outer wear sleeve, by the inner tube, by diverter at one end, and by the bit at the other end;

an inner cylinder mounted inside the outer wear sleeve towards said one end of the chamber adjacent to the diverter defining a fluid communication passage between the diverter and the chamber via porting means;

a piston including strike face adapted to strike said bit, slidably disposed in the annular chamber with respect to the inner cylinder so as to co-operate with the porting means and mounted over the inner tube to reciprocate within the annular chamber and repeatedly strike the bit, defining a shoulder intermediate its ends, one of which defines a lift face, wherein the strike face is defined by a reduced diameter front end portion of the piston, the piston defines a shoulder facing said one end of the chamber opposite the strike face of the piston to which a substantially continuous supply of pressure fluid can be applied via the porting means, the inner cylinder extends only part-way into the annular chamber, wherein the porting means is adapted to apply pressure fluid to the piston so as to maintain a force on the shoulder in the direction of the bit of approximately 30 to 45 percent of the lift force on the lift face during the lift stroke.

2. A reverse circulation down-the-hole drill according to claim 1, wherein sliding contact between the piston and the inner tube disposed within the annular chamber is restricted to a portion of the length of the inner tube being spaced from the diverter, over which enlarged portion the piston moves so as to provide for a clearance gap between the remainder of the inner tube and the piston, and so define a passage for exhausting pressure fluid from the one end of the chamber to the other end past the piston, during the end of the driving stroke and at the commencement of the lift stroke.

3. A reverse circulation down-the-hole drill comprising:

an outer wear sleeve;

a backhead assembly located at one end of the outer wear sleeve for connecting the drill a double walled drill string and to a source of pressure fluid to actuate the drill;

a fluid diverter mounted inside the outer wear sleeve adjacent to the backhead;

inner tub concentric with the outer wear sleeve and extending into the fluid diverter and defining at least part of a central return a passageway in the drill;

a bit located by a chuck at the other end of the outer wear sleeve, slidably mounted on said inner tube in an annular chamber defined by the outer wear sleeve, by the inner tube, by the diverter at one end, and by the bit at the other end;

an inner cylinder mounted inside the outer wear sleeve towards said one end of the chamber adjacent to the diverter defining a fluid communication passage between the diverter and the chamber via porting means;

a piston including a strike face adapted to strike said bit, slidably disposed in said annular chamber with respect to the inner cylinder so as to co-operate with the porting means and mounted over the inner tube to reciprocate within the annular chamber and repeatedly strike the bit, defining shoulder intermediate its end, one of which defines a lift face, wherein the strike face of the piston is defined by a reduced diameter front end portion of the piston, defines a shoulder facing said one end of the chamber opposite the strike face of the piston to which a substantially continuous supply of pressure fluid can be applied via the porting means, the inner cylinder extends only part-way into the annular chamber, wherein the reduced diameter front end portion of the piston is adapted to co-operate with a bush fixedly mounted within the outer wear sleeve, wherein a chamber is defined between the bush and the piston to supply pressure fluid to the lift face of the piston at the commencement of the lift stroke;

and wherein the porting means is adapted to pressure fluid to the piston so as to maintain a force on the shoulder in the direction of the bit of approximately 30 to 45 percent of the lift force on the lift face during the lift stroke.

4. A reverse circulation down-the-hole drill according to claim 3, further comprising a second shoulder provided on the side of the piston such that supply of pressure fluid to the shoulder on the piston is broken during the lift stroke.

5. A reverse circulation down-the-hole drill according to claim 4, wherein grooves are defined on the sides of the piston which in cooperation with the outer wear sleeve and/or the inner cylinder create a chamber in which pressure fluid may be trapped and compressed during the lift stroke.

* * * * *